US011784405B2

(12) United States Patent
Luo et al.

(10) Patent No.: US 11,784,405 B2
(45) Date of Patent: Oct. 10, 2023

(54) SMART ANTENNA, ANTENNA FEEDER SYSTEM, ANTENNA COMMUNICATIONS SYSTEM, AND AP

(71) Applicant: HUAWEI TECHNOLOGIES CO., LTD., Guangdong (CN)

(72) Inventors: Xin Luo, Chengdu (CN); Yi Chen, Chengdu (CN)

(73) Assignee: HUAWEI TECHNOLOGIES CO., LTD., Shenzhen (CN)

( * ) Notice: Subject to any disclaimer, the term of this patent is extended or adjusted under 35 U.S.C. 154(b) by 202 days.

(21) Appl. No.: 17/484,001

(22) Filed: Sep. 24, 2021

(65) Prior Publication Data

US 2022/0013900 A1 Jan. 13, 2022

Related U.S. Application Data

(63) Continuation of application No. PCT/CN2019/079661, filed on Mar. 26, 2019.

(51) Int. Cl.
*H01Q 3/24* (2006.01)
*H01Q 21/00* (2006.01)
*H01Q 1/24* (2006.01)

(52) U.S. Cl.
CPC ..... *H01Q 3/24* (2013.01); *H01Q 1/246* (2013.01); *H01Q 21/0006* (2013.01)

(58) Field of Classification Search
CPC ..... H01Q 3/24; H01Q 3/247; H01Q 21/0006; H01Q 5/30; H01Q 5/307; H01Q 5/314; H01Q 5/321; H01Q 5/328; H01Q 5/335
See application file for complete search history.

(56) References Cited

U.S. PATENT DOCUMENTS

2002/0036586 A1 3/2002 Gothard et al.
2005/0219121 A1* 10/2005 Chen ..... H01Q 1/246 342/374

(Continued)

FOREIGN PATENT DOCUMENTS

CN 202977730 U 6/2013
CN 204289711 U 4/2015

(Continued)

OTHER PUBLICATIONS

Li Xiangyang, Infocom Interesting Stories, Changchun Film Studio Silver Sound Image Publishing House, 2009, 5 pages (with an English abstract).

(Continued)

*Primary Examiner* — Jason Crawford

(57) ABSTRACT

A smart antenna, an antenna feeder system, an antenna communications system, and an Access Point (AP) are provided. The smart antenna includes an antenna element array and an impedance transformation circuit. A feeding end of the antenna element array is connected to a first end of the impedance transformation circuit, a second end of the impedance transformation circuit is an input end of the smart antenna, and the input end of the smart antenna is connected to a feeder. The antenna element array can form a plurality of different beam shapes, and the impedance transformation circuit is configured to transform the different input impedance of the feeding end of the antenna element array into preset input impedance at the input end of the smart antenna.

14 Claims, 4 Drawing Sheets

(56) References Cited

U.S. PATENT DOCUMENTS

| | | | | |
|---|---|---|---|---|
| 2005/0280589 | A1* | 12/2005 | Chiang | H01Q 19/26 343/702 |
| 2006/0022890 | A1* | 2/2006 | Chiang | H01Q 19/22 343/834 |
| 2006/0044205 | A1* | 3/2006 | Lynch | H01Q 9/42 343/702 |
| 2008/0266192 | A1 | 10/2008 | Tuttle | |
| 2010/0195753 | A1* | 8/2010 | Yamamoto | H01Q 1/243 375/267 |
| 2011/0193652 | A1* | 8/2011 | Wu | H01Q 21/08 333/101 |
| 2014/0062817 | A1* | 3/2014 | Ishizuka | H03H 7/40 330/192 |
| 2015/0333413 | A1* | 11/2015 | Piazza | H01Q 3/44 342/374 |
| 2016/0036127 | A1* | 2/2016 | Desclos | H01Q 5/378 343/745 |
| 2016/0093951 | A1* | 3/2016 | Schmid | H01Q 1/48 343/876 |
| 2019/0341701 | A1* | 11/2019 | Yu | H01Q 1/50 |
| 2020/0203853 | A1* | 6/2020 | Hu | H01Q 21/28 |
| 2022/0013900 | A1* | 1/2022 | Luo | H01Q 21/0006 |

FOREIGN PATENT DOCUMENTS

| | | | |
|---|---|---|---|
| CN | 106887696 | A | 6/2017 |
| CN | 109411876 | A | 3/2019 |
| JP | 2013021592 | A | 1/2013 |
| TW | 200620749 | A | 6/2006 |
| WO | 2014165320 | A2 | 10/2014 |
| WO | 2017197807 | A1 | 11/2017 |

OTHER PUBLICATIONS

Fu Lin, Electromagnetic Fields and Electromagnetic Waves: Theory and Simulation, Beijing Institute of Technology Press, 2018, 7 pages (with an English abstract).

Office Action issued in CN201980051024.0, dated Dec. 8, 2021, 8 pages.

IEEE Std 802.11acTM-2013, IEEE Standard for Information technology—Telecommunications and information exchange between systems Local and metropolitan area networks—Specific requirements, Part 11: Wireless LAN Medium Access Control (MAC) and Physical Layer (PHY) Specifications, Amendment 4: Enhancements for Very High Throughput for Operation in Bands below 6 GHz, Approved Dec. 11, 2013, total 425 pages.

IEEE P802.11axTM/D1.2, Apr. 2017 , Draft Standard for Information technology—Tele-communications and information exchange between systems Local and metropolitan area networks—Specific requirements, Part 11: Wireless LAN Medium Access Control (MAC) and Physical Layer (PHY) Specifications, Amendment 6: Enhancements for High Efficiency WLAN, total 488 pages.

International Search Report and Written Opinion issued in PCT/CN2019/079661, dated Dec. 17, 2019, 9 pages.

Office Action issued in CN201980051024.0, dated Jun. 29, 2021, 8 pages.

Extended European Search Report issued in EP19921729.0, dated Feb. 11, 2022, 8 pages.

* cited by examiner

SMART ANTENNA, ANTENNA FEEDER SYSTEM, ANTENNA COMMUNICATIONS SYSTEM, AND AP

CROSS-REFERENCE TO RELATED APPLICATIONS

This application is a continuation of International Application No. PCT/CN2019/079661, filed on Mar. 26, 2019, the disclosure of which is hereby incorporated by reference in its entirety.

TECHNICAL FIELD

This application relates to the field of communications technologies, and in particular, to a smart antenna, an antenna feeder system, an antenna communications system, and an access point (AP).

BACKGROUND

With continuous development of communications technologies, omnidirectional antennas gradually develop towards smart antennas. An omnidirectional antenna uniformly covers all directions with radiant energy, whereas a smart antenna may concentratedly cover a user location direction with radiant energy based on a user location. The smart antenna is usually capable of forming a plurality of different beam shapes.

When a beam shape formed by the smart antenna is different, usually, an input impedance of the smart antenna is also different. A larger additional gain that the smart antenna can obtain for the plurality of different beam shapes that can be formed by the smart antenna indicates a larger change in an input impedance of the smart antenna.

However, if the smart antenna is to radiate, without reflection, a power signal transmitted by a feeder, a precondition is that an input impedance of the smart antenna is equal to characteristic impedance of the feeder. If the input impedance is not equal to the characteristic impedance, reflection occurs, and a larger difference results in larger reflection. To ensure normal radiation of the power signal, it is usually required that the input impedance of the smart antenna be not less than one half of the characteristic impedance of the feeder and not greater than twice the characteristic impedance, so that a reflection coefficient is less than −10 dB (decibels).

In the foregoing case, the input impedance of the smart antenna is limited to be not less than one half of the characteristic impedance of the feeder and not greater than twice the characteristic impedance. As a result, an additional gain that the smart antenna can obtain for the plurality of different beam shapes that can be formed by the smart antenna is limited, and moreover, a comparatively large change in the reflection coefficient of the smart antenna occurs when the input impedance of the smart antenna changes. This causes a comparatively large change in a return loss of the smart antenna, and consequently, an operating bandwidth of the smart antenna is comparatively small.

SUMMARY

Example embodiments of this application provide a smart antenna, an antenna feeder system, an antenna communications system, and an AP, to resolve a problem that an operating bandwidth of a smart antenna is comparatively small in a related technology. Example technical solutions are described as follows.

According to a first aspect, a smart antenna is provided. The smart antenna includes an antenna element array and an impedance transformation circuit.

A feeding end of the antenna element array is connected to a first end of the impedance transformation circuit. A second end of the impedance transformation circuit is an input end of the smart antenna. The input end of the smart antenna is connected to a feeder. The antenna element array can form a plurality of different beam shapes. For the plurality of different beam shapes, the feeding end of the antenna element array has different input impedance. The impedance transformation circuit is configured to transform the different input impedance of the feeding end of the antenna element array into preset input impedance at the input end of the smart antenna. A difference between the preset input impedance and characteristic impedance of the feeder is less than a preset value.

In this embodiment of this application, when a change in the input impedance of the feeding end of the antenna element array is comparatively large, an input impedance of the input end of the smart antenna can still remain unchanged, and is always the preset input impedance. In addition, because the difference between the preset input impedance and the characteristic impedance of the feeder is less than the preset value, that is, a difference between the input impedance of the input end of the smart antenna and the characteristic impedance of the feeder is comparatively small, the smart antenna can radiate, almost without reflection, a power signal sent by the feeder, and a reflection coefficient is quite small.

In the foregoing case, a limitation on a change in the input impedance of the feeding end of the antenna element array is comparatively small, that is, the input impedance of the feeding end of the antenna element array may undergo a comparatively large change. In this way, the antenna element array can obtain a comparatively large additional gain for the plurality of different beam shapes that can be formed by the antenna element array. In addition, when a change in the input impedance of the feeding end of the antenna element array is comparatively large, the reflection coefficient of the smart antenna is almost unchanged and is quite small, so that a return loss of the smart antenna is almost unchanged and is quite small. This can effectively ensure a comparatively large operating bandwidth of the smart antenna.

The antenna element array includes a first element, a second element, and a switch. One end of the first element is connected to the first end of the impedance transformation circuit. One end of the second element is connected to a first end of the switch. A second end of the switch is grounded. A beam shape formed by the antenna element array when the switch is on is different from a beam shape formed by the antenna element array when the switch is off.

In this embodiment of this application, when the switch is on, electromagnetic induction occurs between the second element and the first element, so that an induced current is generated on the second element; when the switch is off, electromagnetic induction does not occur between the second element and the first element, and therefore, no induced current is generated on the second element. When generating an induced current, the second element reflects or attracts an electromagnetic wave emitted by the first element. Therefore, when the second element generates an induced current, the first element forms a beam shape, and when the second element generates no induced current, the first element forms another beam shape. In this way, the antenna element array can form two different beam shapes, and for the two different beam shapes, the feeding end of the antenna element array has different input impedance.

Further, the antenna element array further includes a baseplate, and the first element and the second element are installed on the baseplate.

In this embodiment of this application, the first element and the second element are installed in different positions on the baseplate, and the first element and the second element may be installed on the baseplate in a preset arrangement manner.

Further, the antenna element array further includes a switch control circuit. The switch control circuit is connected to a control end of the switch, and the switch control circuit is configured to control the switch to be turned on or turned off.

In this embodiment of this application, the switch control circuit may be used for controlling the switch to be turned on or turned off, to control the antenna element array to form the two different beam shapes, thereby meeting a use requirement.

The impedance transformation circuit includes a transmission line. The transmission line may be a coplanar microstrip transmission line, a microwave groove line, a parallel dual line, a microstrip, or a strip line. In this case, the impedance transformation circuit may transform the different input impedance of the feeding end of the antenna element array into the preset input impedance at the input end of the smart antenna according to the following formula:

$$Z_1 = R\frac{Z_2 + jR\tan\beta a}{R + jZ_2\tan\beta a}$$

$Z_1$ is the preset input impedance, $Z_2$ is the input impedance of the feeding end of the antenna element array, R is the characteristic impedance of the feeder, j is an imaginary-part unit, β is a free-space wave number of an electromagnetic wave of the antenna element array, and a is a length of the transmission line.

According to a second aspect, an antenna feeder system is provided. The antenna feeder system includes a feeder and the smart antenna according to the first aspect. An input end of the smart antenna is connected to the feeder.

According to a third aspect, an antenna communications system is provided. The antenna communications system includes a transmitter, a feeder, and the smart antenna according to the first aspect. The feeder is connected between the transmitter and the smart antenna.

According to a fourth aspect, an AP is provided. The AP includes the smart antenna according to the first aspect.

Technical effects obtained by the second aspect, the third aspect, or the fourth aspect are similar to technical effects obtained by a corresponding technical means in the first aspect.

The technical solutions provided in this application can bring at least the following beneficial effects:

The smart antenna includes the antenna element array and the impedance transformation circuit. The feeding end of the antenna element array is connected to the first end of the impedance transformation circuit. The second end of the impedance transformation circuit is the input end of the smart antenna. The input end of the smart antenna is connected to the feeder. The antenna element array can form a plurality of different beam shapes. For the plurality of different beam shapes, the feeding end of the antenna element array has different input impedance. The impedance transformation circuit is configured to transform the different input impedance of the feeding end of the antenna element array into the preset input impedance at the input end of the smart antenna. The difference between the preset input impedance and the characteristic impedance of the feeder is less than the preset value. In the embodiments of this application, when a change in the input impedance of the feeding end of the antenna element array is comparatively large, the input impedance of the input end of the smart antenna can still remain unchanged, and is always the preset input impedance. Because the difference between the preset input impedance and the characteristic impedance of the feeder is less than the preset value, that is, the difference between the input impedance of the input end of the smart antenna and the characteristic impedance of the feeder is comparatively small, the smart antenna can radiate, almost without reflection, a power signal sent by the feeder, and the reflection coefficient is quite small. In this way, while the antenna element array can obtain a comparatively large additional gain for the plurality of different beam shapes that can be formed by the antenna element array, the return loss of the smart antenna is almost unchanged and is quite small. This can effectively ensure a comparatively large operating bandwidth of the smart antenna.

Reference signs:

1: antenna element array; 1*a*: feeding end of the antenna element array; 11: first element; 12: second element; 13: switch; 13*a*: first end of the switch; 13*b*: second end of the switch; 13*c*: control end of the switch; 14: switch control circuit; 2: impedance transformation circuit; 2*a*: first end of the impedance transformation circuit; 2*b*: second end of the impedance transformation circuit

DESCRIPTION OF EMBODIMENTS

To make the objectives, technical solutions, and advantages of this application clearer, the following further describes example embodiments of this application in detail with reference to the accompanying drawings.

Figure 1:
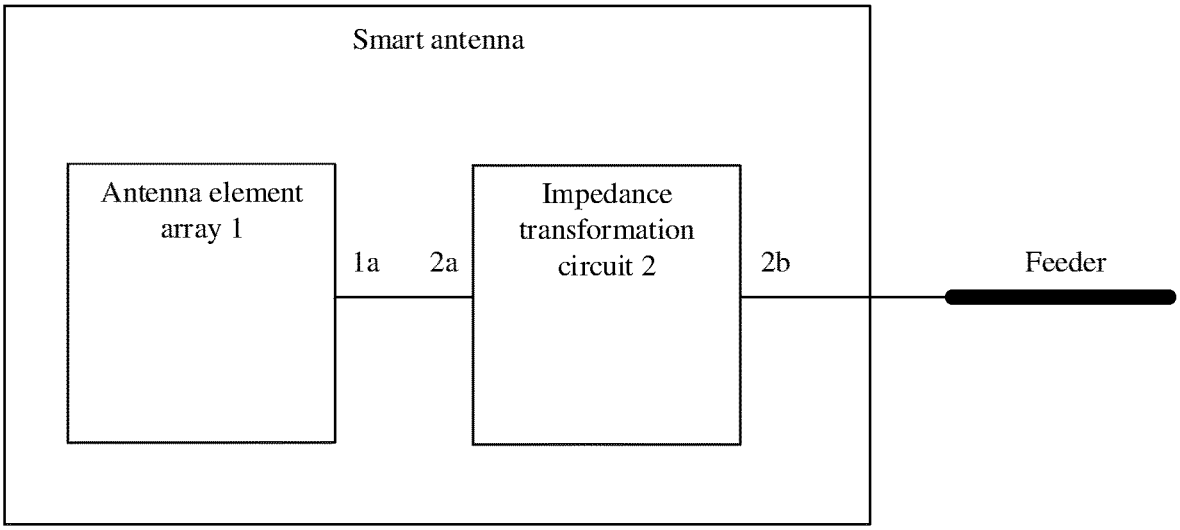
FIG. 1 is a schematic structural diagram of a smart antenna according to an embodiment of this application.

FIG. 1 is a schematic structural diagram of a smart antenna according to an embodiment of this application. Referring to FIG. 1, the smart antenna includes an antenna element array 1 and an impedance transformation circuit 2.

A feeding end 1*a* of the antenna element array 1 is connected to a first end 2*a* of the impedance transformation circuit 2. A second end 2*b* of the impedance transformation circuit 2 is an input end of the smart antenna. The input end of the smart antenna is connected to a feeder. The antenna element array 1 can form a plurality of different beam shapes. For the plurality of different beam shapes, the feeding end 1*a* of the antenna element array 1 has different input impedance. The impedance transformation circuit 2 is configured to transform the different input impedance of the feeding end 1*a* of the antenna element array 1 into preset input impedance at the input end of the smart antenna. A difference between the preset input impedance and characteristic impedance of the feeder is less than a preset value.

Specifically, the feeder is configured to transmit a power signal. The feeder may transmit the power signal to the antenna element array 1 by using the impedance transformation circuit 2, and the antenna element array 1 may emit the transmitted power signal.

It should be noted that a beam shape that can be formed by the antenna element array 1 is a shape that is formed on a surface of the earth and that is of an electromagnetic wave emitted by the antenna element array 1. That the antenna element array 1 can form a plurality of different beam shapes means that the antenna element array 1 can change radiation capabilities of the antenna element array 1 for different directions in space. In an example embodiment, radiation capabilities of the antenna element array 1 in all directions in space are the same, that is, the antenna element array 1 may uniformly cover all the directions with radiant energy. In this case, the antenna element array 1 is in an omnidirectional mode. Alternatively, a radiation capability of the antenna element array 1 in a specific direction in space may be greater than a radiation capability in another direction, that is, the antenna element array 1 may cover a specific direction with radiant energy in a comparatively concentrated manner. In this case, the antenna element array 1 is in a directional mode.

In addition, when a beam shape formed by the antenna element array 1 is different, an input impedance of the feeding end 1*a* of the antenna element array 1 is also different. A larger additional gain that the antenna element array 1 can obtain for the plurality of different beam shapes that can be formed by the antenna element array 1 indicates a larger change in an input impedance of the feeding end 1*a* of the antenna element array 1.

It should be noted that both the preset input impedance and the preset value may be set in advance, and the preset input impedance may be set to be very close to the characteristic impedance of the feeder, that is, the preset value may be set to be very small. For example, the preset value may be any value greater than or equal to 0 and less than one half of the characteristic impedance of the feeder.

In addition, the impedance transformation circuit 2 can transform the different input impedance of the feeding end 1*a* of the antenna element array 1 into the preset input impedance at the input end of the smart antenna. In this way, even when the input impedance of the feeding end 1*a* of the antenna element array 1 undergoes a very large change, for the input end of the smart antenna, an input impedance of the input end of the smart antenna is substantially unchanged.

It should be noted that, in this embodiment of this application, when a change in the input impedance of the feeding end 1*a* of the antenna element array 1 is comparatively large, the input impedance of the input end of the smart antenna can still remain unchanged, and is always the preset input impedance. In addition, because the difference between the preset input impedance and the characteristic impedance of the feeder is less than the preset value, that is, a difference between the input impedance of the input end of the smart antenna and the characteristic impedance of the feeder is comparatively small, the smart antenna can radiate, almost without reflection, the power signal sent by the feeder, and a reflection coefficient is quite small.

In the foregoing case, a limitation on a change in the input impedance of the feeding end 1*a* of the antenna element array 1 is comparatively small, that is, the input impedance of the feeding end 1*a* of the antenna element array 1 may undergo a comparatively large change. In this way, the antenna element array 1 can obtain a comparatively large additional gain for the plurality of different beam shapes that can be formed by the antenna element array 1. In addition, when a change in the input impedance of the feeding end 1*a* of the antenna element array 1 is comparatively large, the reflection coefficient of the smart antenna is almost unchanged and is quite small, so that a return loss of the smart antenna is almost unchanged and is quite small. This can effectively ensure a comparatively large operating bandwidth of the smart antenna.

Figure 2:
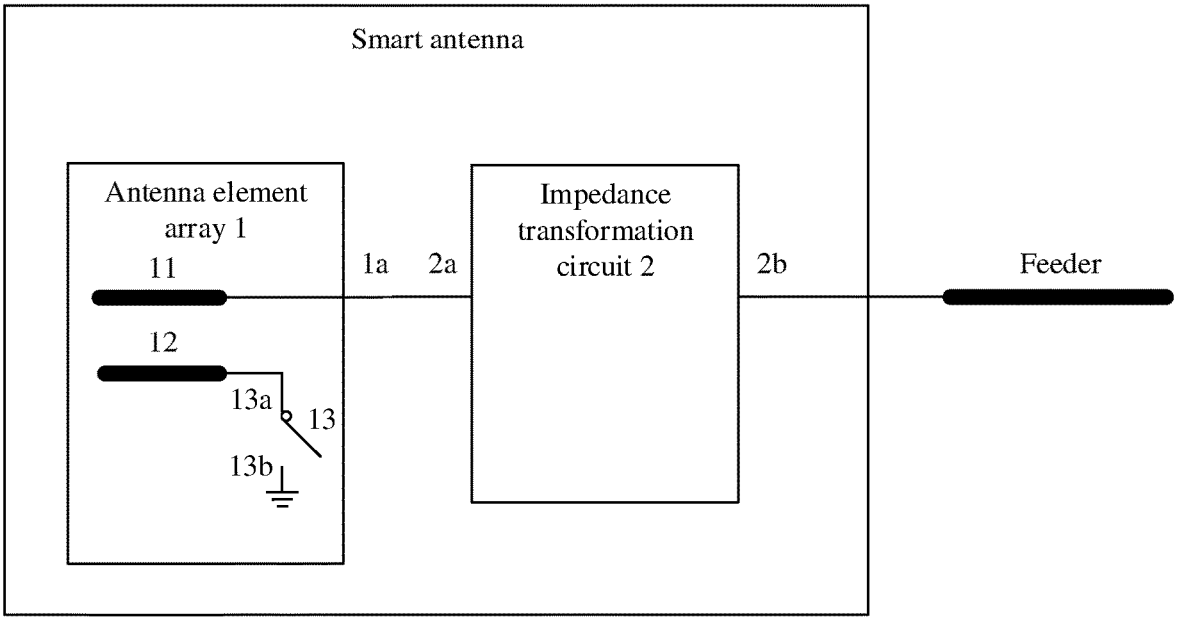
FIG. 2 is a schematic structural diagram of another smart antenna according to an embodiment of this application.

Referring to FIG. 2, the antenna element array includes a first element 11, a second element 12, and a switch 13. One end of the first element 11 is connected to the first end 2*a* of the impedance transformation circuit 2. One end of the second element 12 is connected to a first end 13*a* of the switch 13. A second end 13*b* of the switch 13 is grounded. A beam shape formed by the antenna element array 1 when the switch 13 is on is different from a beam shape formed by the antenna element array 1 when the switch 13 is off.

In an example embodiment, when the switch 13 is on, the antenna element array 1 may be in the directional mode; when the switch 13 is off, the antenna element array 1 may be in the omnidirectional mode.

It should be noted that, when the switch 13 is on, electromagnetic induction occurs between the second element 12 and the first element 11, so that an induced current is generated on the second element 12; when the switch 13 is off, electromagnetic induction does not occur between the second element 12 and the first element 11, and therefore, no induced current is generated on the second element 12. When generating an induced current, the second element 12 reflects or attracts an electromagnetic wave emitted by the first element 11. Therefore, when the second element 12 generates an induced current, the first element 11 forms a beam shape, and when the second element 12 generates no induced current, the first element 11 forms another beam shape. In this way, the antenna element array 1 can form two different beam shapes, and for the two different beam shapes, the feeding end 1*a* of the antenna element array 1 has different input impedance.

Further, the antenna element array 1 may further include a baseplate, and the first element 11 and the second element 12 are installed on the baseplate.

It should be noted that the first element 11 and the second element 12 are installed in different positions on the baseplate, and the first element 11 and the second element 12 may be installed on the baseplate in a preset arrangement manner. For example, the first element 11 and the second element 12 may be installed on the baseplate in a parallel arrangement manner. This is not limited in embodiments of this application.

Figure 3:
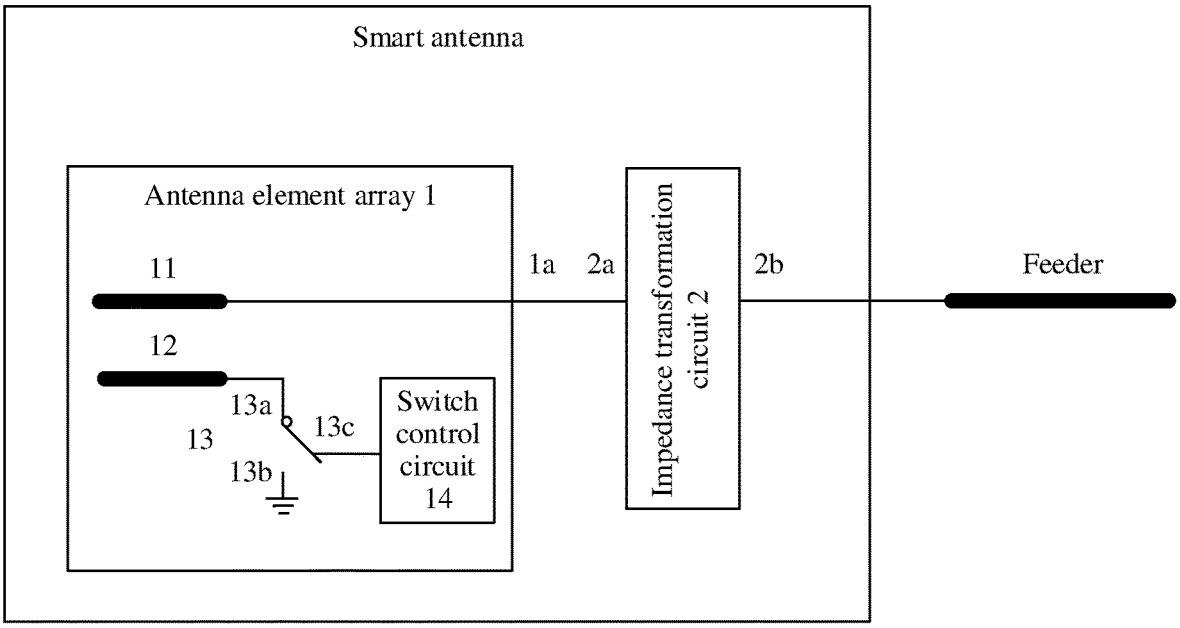
FIG. 3 is a schematic structural diagram of still another smart antenna according to an embodiment of this application.

Further, referring to FIG. 3, the antenna element array 1 may further include a switch control circuit 14. The switch control circuit 14 is connected to a control end 13*c* of the switch 13, and the switch control circuit 14 is configured to control the switch 13 to be turned on or turned off.

It should be noted that an on state and off state of the switch 13 respectively correspond to the two different beam shapes that can be formed by the antenna element array 1. In this embodiment of this application, the switch control circuit 14 may be used for controlling the switch 13 to be turned on or turned off, to control the antenna element array 1 to form the two different beam shapes, thereby meeting a use requirement.

In an example embodiment, the impedance transformation circuit 2 may include a transmission line. The transmission line may be a coplanar microstrip transmission line, a microwave groove line, a parallel dual line, a microstrip, a strip line, or the like. This is not limited in embodiments of this application.

When the impedance transformation circuit 2 includes the transmission line, the impedance transformation circuit 2 may transform the different input impedance of the feeding end 1*a* of the antenna element array 1 into the preset input impedance at the input end of the smart antenna based on a formula $$Z_1 = R\frac{Z_2 + jR\tan\beta a}{R + jZ_2\tan\beta a}.$$

Certainly, the impedance transformation circuit 2 may alternatively transform the different input impedance of the feeding end 1*a* of the antenna element array 1 into the preset input impedance at the input end of the smart antenna based on another formula. This is not limited in embodiments of this application.

$Z_1$ is the preset input impedance, $Z_2$ is the input impedance of the feeding end 1*a* of the antenna element array 1, R is the characteristic impedance of the feeder, j is an imaginary-part unit, β is a free-space wave number of an electromagnetic wave of the antenna element array 1, and a is a length of the transmission line. The free-space wave number of the electromagnetic wave of the antenna element array 1 is a quantity of wavelengths included in a free-space distance of 2π, and may be obtained by dividing 2π by a wavelength of the electromagnetic wave emitted by the antenna element array 1.

It should be noted that, as an alternative to the transmission line, the impedance transformation circuit 2 may include another component, for example, may include at least one of an inductor, a capacitor, or the like, provided that the impedance transformation circuit 2 can implement a function of transforming the different input impedance of the feeding end 1*a* of the antenna element array 1 into the preset input impedance at the input end of the smart antenna. When composition of the impedance transformation circuit 2 is different, the impedance transformation circuit 2 may transform the different input impedance of the feeding end 1*a* of the antenna element array 1 into the preset input impedance at the input end of the smart antenna based on a different formula. This is not limited in embodiments of this application.

In the embodiments of this application, the smart antenna includes the antenna element array 1 and the impedance transformation circuit 2. The feeding end 1*a* of the antenna element array 1 is connected to the first end 2*a* of the impedance transformation circuit 2. The second end 2*b* of the impedance transformation circuit 2 is the input end of the smart antenna. The input end of the smart antenna is connected to the feeder. The antenna element array 1 can form a plurality of different beam shapes. For the plurality of different beam shapes, the feeding end 1*a* of the antenna element array 1 has different input impedance. The impedance transformation circuit 2 is configured to transform the different input impedance of the feeding end 1*a* of the antenna element array 1 into the preset input impedance at the input end of the smart antenna. The difference between the preset input impedance and the characteristic impedance of the feeder is less than the preset value. In the embodiments of this application, when a change in the input impedance of the feeding end 1*a* of the antenna element array 1 is comparatively large, the input impedance of the input end of the smart antenna can still remain unchanged, and is always the preset input impedance. Because the difference between the preset input impedance and the characteristic impedance of the feeder is less than the preset value, that is, the difference between the input impedance of the input end of the smart antenna and the characteristic impedance of the feeder is comparatively small, the smart antenna can radiate, almost without reflection, the power signal sent by the feeder, and the reflection coefficient is quite small. In this way, while the antenna element array 1 can obtain a comparatively large additional gain for the plurality of different beam shapes that can be formed by the antenna element array 1, the return loss of the smart antenna is almost unchanged and is quite small. This can effectively ensure a comparatively large operating bandwidth of the smart antenna.

The following describes technical effects of the smart antenna provided in the embodiments of this application, with reference to specific examples.

To ensure normal radiation of the power signal, it is usually required that the input impedance of the smart antenna be not less than one half of the characteristic impedance of the feeder and not greater than twice the characteristic impedance, so that the reflection coefficient is less than −10 dB.

Figure 4:
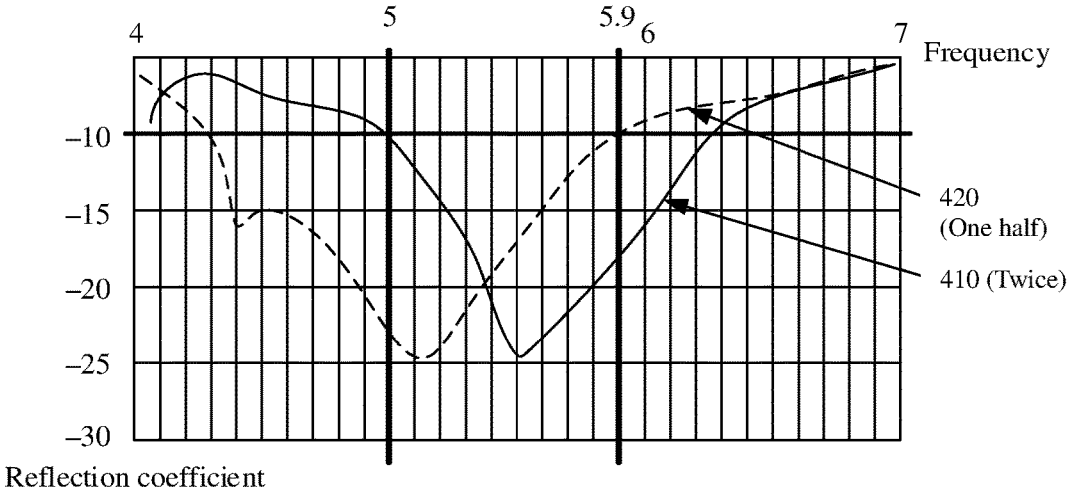
FIG. 4 is a return loss curve diagram according to an embodiment of this application.

In a related technology, a smart antenna includes an antenna element array, a feeding end of the antenna element array is an input end of the smart antenna, and the input end of the smart antenna is connected to a feeder. Therefore, an input impedance of the feeding end of the antenna element array needs to be not less than one half of characteristic impedance of the feeder and not greater than twice the characteristic impedance. It is assumed that the antenna element array can form two different beam shapes. To enable the antenna element array to obtain a comparatively large additional gain for the two different beam shapes, input impedance of the feeding end of the antenna element array are usually set to twice the characteristic impedance of the feeder and one half of the characteristic impedance, respectively. In this case, a change in an input impedance of the input end of the smart antenna is comparatively large, and a change in a reflection coefficient of the smart antenna is also comparatively large. This causes a comparatively large change in a return loss of the smart antenna. Specifically, in a return loss curve diagram (S11 curve diagram) shown in FIG. 4, an S11 curve 410 (solid-line) obtained when the input impedance of the feeding end of the antenna element array is twice the characteristic impedance of the feeder does not overlap an S11 curve 420 (dashed-line) obtained when the input impedance of the feeding end of the antenna element array is one half of the characteristic impedance of the feeder. The former is more of high frequency, and the latter is more of low frequency. In this case, an operating bandwidth of the smart antenna is an intersection of the two, that is, 0.9 GHz (gigahertz).

Figure 5:
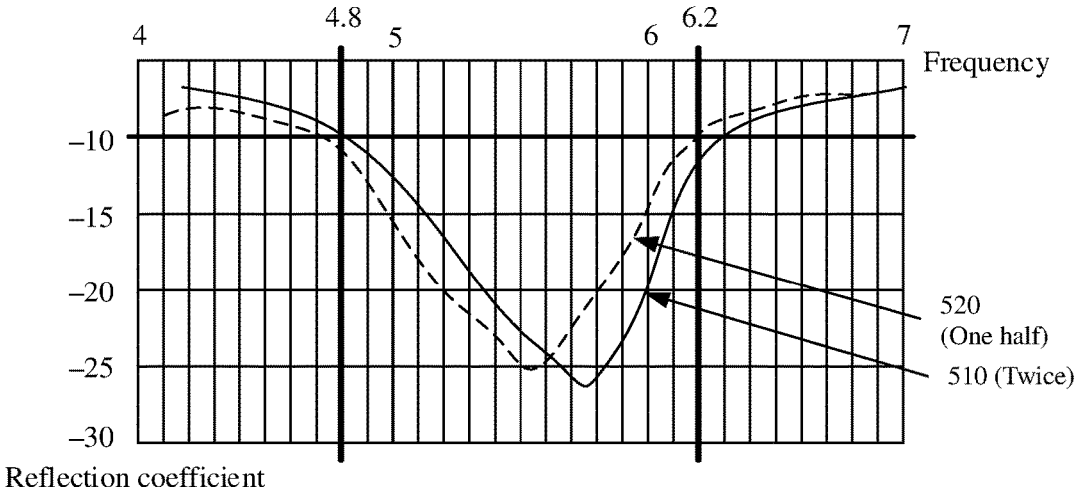
FIG. 5 is another return loss curve diagram according to an embodiment of this application.

In the embodiments of this application, the smart antenna includes the antenna element array 1 and the impedance transformation circuit 2, the feeding end 1*a* of the antenna element array 1 is connected to the first end 2*a* of the impedance transformation circuit 2, the second end 2*b* of the impedance transformation circuit 2 is the input end of the smart antenna, and the input end of the smart antenna is connected to the feeder. It is assumed that the antenna element array can form two different beam shapes, and it is assumed that input impedance of the feeding end of the antenna element array for the two different beam shapes are twice the characteristic impedance of the feeder and one half of the characteristic impedance, respectively. In this case, because the impedance transformation circuit 2 can transform, at the input end of the smart antenna, the different input impedance of the feeding end 1*a* of the antenna element array 1 into the preset input impedance that is very close to the characteristic impedance of the feeder, the reflection coefficient of the smart antenna is almost unchanged and is quite small, so that the return loss of the smart antenna is almost unchanged and is quite small. Specifically, in an S11 curve diagram shown in FIG. 5, an S11 curve 510 (solid-line) obtained when the input impedance of the feeding end of the antenna element array is twice the characteristic impedance of the feeder almost overlaps an S11 curve 520 (dashed-line) obtained when the input impedance of the feeding end of the antenna element array is one half of the characteristic impedance of the feeder. In this case, an operating bandwidth of the smart antenna reaches 1.4 GHz. Compared with the operating bandwidth of the smart antenna in the related technology, the operating bandwidth of the smart antenna provided in the embodiments of this application is significantly improved.

Figure 6:
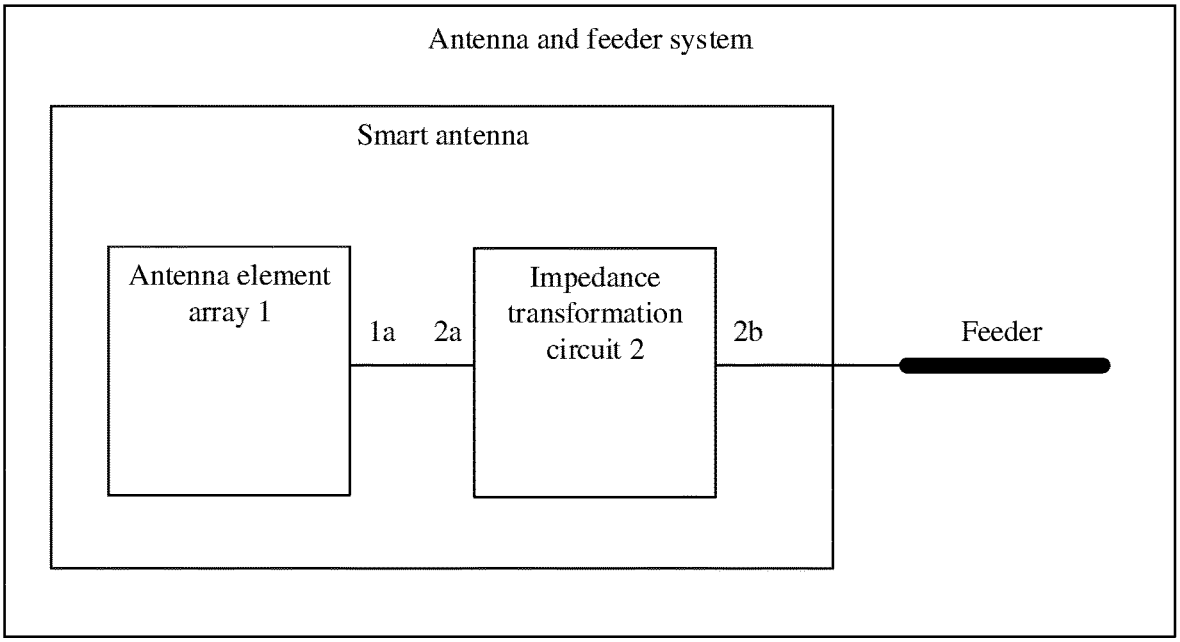
FIG. 6 is a schematic structural diagram of an antenna feeder system according to an embodiment of this application.

FIG. 6 is a schematic structural diagram of an antenna feeder system according to an embodiment of this application. Referring to FIG. 6, the antenna feeder system may include a feeder and the smart antenna described in the foregoing embodiments. An input end of the smart antenna is connected to the feeder. The smart antenna may receive a power signal sent by the feeder and radiate the power signal.

Figure 7:
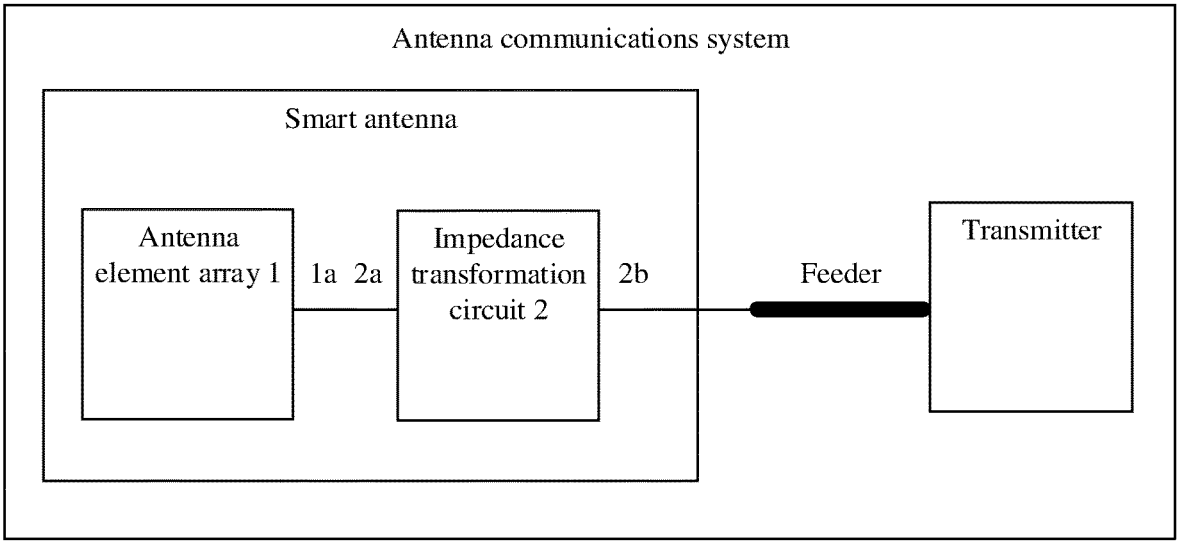
FIG. 7 is a schematic structural diagram of an antenna communications system according to an embodiment of this application.

FIG. 7 is a schematic structural diagram of an antenna communications system according to an embodiment of this application. Referring to FIG. 7, the antenna communications system may include a transmitter, a feeder, and the smart antenna described in the foregoing embodiments. The feeder is connected between the transmitter and the smart antenna. The transmitter may send a power signal to the smart antenna by using the feeder, and the smart antenna may radiate the power signal.

An embodiment of this application further provides an AP. The AP may include the smart antenna described in any of the foregoing embodiments. For example, the AP may include the antenna feeder system described in any of the foregoing embodiments, or may include the antenna communications system described in any of the foregoing embodiments.

The foregoing descriptions are the embodiments provided in this application, but are not intended to limit this application. Any modification, equivalent replacement, improvement, or the like made without departing from the spirit and principle of this application shall fall within the protection scope of this application.

What is claimed is:

1. A smart antenna, comprising an antenna element array and an impedance transformation circuit, wherein a feeding end of the antenna element array is connected to a first end of the impedance transformation circuit, a second end of the impedance transformation circuit is an input end of the smart antenna, and the input end of the smart antenna is configured to connect to a feeder;

the antenna element array is configured to form a plurality of different beam shapes, and for the plurality of different beam shapes, the feeding end of the antenna element array has different input impedance; and the impedance transformation circuit is configured to transform the different input impedance of the feeding end of the antenna element array into preset input impedance at the input end of the smart antenna, and a difference between the preset input impedance and characteristic impedance of the feeder is less than a preset value.

2. The smart antenna according to claim 1, wherein the antenna element array comprises a first element, a second element, and a switch;

one end of the first element is connected to the first end of the impedance transformation circuit, one end of the second element is connected to a first end of the switch, and a second end of the switch is grounded; and a beam shape formed by the antenna element array when the switch is on is different from a beam shape formed by the antenna element array when the switch is off.

3. The smart antenna according to claim 2, wherein the antenna element array further comprises a baseplate; and the first element and the second element are installed on the baseplate.

4. The smart antenna according to claim 3, wherein the first element and the second element are disposed on the baseplate in parallel.

5. The smart antenna according to claim 2, wherein the antenna element array further comprises a switch control circuit; and the switch control circuit is connected to a control end of the switch, and the switch control circuit is configured to control the switch to be turned on or turned off.

6. The smart antenna according to claim 1, wherein the impedance transformation circuit comprises a transmission line.

7. The smart antenna according to claim 6, wherein the transmission line is a coplanar microstrip transmission line, a microwave groove line, a parallel dual line, a microstrip, or a strip line.

8. The smart antenna according to claim 7, wherein the impedance transformation circuit is further configured to transform the different input impedance of the feeding end of the antenna element array into the preset input impedance at the input end of the smart antenna according to the following formula:

$$Z_1 = R\frac{Z_2 + jR\tan\beta a}{R + jZ_2\tan\beta a}$$

wherein $Z_1$ is the preset input impedance, $Z_2$ is the input impedance of the feeding end of the antenna element array, R is the characteristic impedance of the feeder, j is an imaginary-part unit, β is a free-space wave number of an electromagnetic wave of the antenna element array, and a is a length of the transmission line.

9. The smart antenna according to claim 8, wherein the free-space wave number of the electromagnetic wave of the antenna element array is a quantity of wavelengths included in a free-space distance of $2\pi$.

10. The smart antenna according to claim 1, wherein the antenna element array is configured to change radiation capabilities of the antenna element array for a plurality of directions in space.

11. The smart antenna according to claim 10, wherein the radiation capabilities of the antenna element array in the plurality of directions are substantially the same.

12. The smart antenna according to claim 10, wherein the radiation capability of the antenna element array in one of the plurality of directions in space is greater than the radiation capabilities in the other directions of the plurality of directions in space.

13. An antenna feeder system, wherein the antenna feeder system comprises a feeder and the smart antenna according to claim 1, and the input end of the smart antenna is connected to the feeder.

14. An access point (AP), wherein the AP comprises the smart antenna according to claim 1.

* * * * *